US005421876A

United States Patent [19]

Janoski

[11] Patent Number: 5,421,876

[45] Date of Patent: Jun. 6, 1995

[54] SOLVENT-FREE, ORGANOCLAY-FILLED ASPHALTIC POLYURETHANE DISPERSION AND METHOD OF MAKING AND USING IT

[75] Inventor: Ronald J. Janoski, Chagrin Falls, Ohio

[73] Assignee: Tremco, Inc., Beachwood, Ohio

[21] Appl. No.: 138,562

[22] Filed: Oct. 18, 1993

Related U.S. Application Data

[63] Continuation-in-part of Ser. No. 633,561, Dec. 21, 1990, Pat. No. 5,253,461.

[51] Int. Cl.[6] ..... C09D 195/00

[52] U.S. Cl. ..... 106/278; 106/269; 106/277

[58] Field of Search ..... 106/269, 277, 278

[56] References Cited

U.S. PATENT DOCUMENTS

| | | | |
|---|---|---|---|
| 3,094,447 | 6/1963 | Chamberlain | 52/746 |
| 3,179,610 | 4/1965 | Wood | 524/705 |
| 3,637,558 | 1/1972 | Verdol et al. | 524/705 |
| 3,909,474 | 9/1975 | Borchert et al. | 106/277 |
| 3,980,597 | 9/1976 | Shihadeh | 260/28 R |
| 4,018,730 | 4/1977 | McDonald | 106/277 |
| 4,137,204 | 1/1979 | McDonald | 106/277 |
| 4,412,864 | 11/1983 | Kurashige et al. | 524/59 |
| 4,597,817 | 7/1986 | Larsen | 52/746 |
| 4,724,245 | 2/1988 | Lalanne et al. | 525/54.5 |
| 4,793,886 | 12/1988 | Okamura et al. | 156/307.3 |
| 4,795,760 | 1/1989 | Lucke | 524/59 |
| 4,871,792 | 10/1989 | Lucke | 524/59 |
| 4,950,701 | 8/1990 | Okamura et al. | 524/237 |
| 4,970,025 | 11/1990 | Demangeon et al. | 106/277 |
| 5,008,311 | 4/1991 | Janoski | 524/59 |
| 5,045,590 | 9/1991 | Motomura et al. | 524/705 |
| 5,253,461 | 10/1993 | Janoski | 156/71 |
| 5,319,008 | 6/1994 | Janoski | 106/277 |

FOREIGN PATENT DOCUMENTS

| | | | |
|---|---|---|---|
| 720855 | 11/1965 | Canada | 524/59 |
| 587725 | 1/1980 | U.S.S.R. | 524/705 |

OTHER PUBLICATIONS

Structure and Composition of TIXOGEL (no date avail.).

*Primary Examiner*—David Brunsman

*Attorney, Agent, or Firm*—David P. Dureska; Alfred D. Lobo

[57] ABSTRACT

An organoclay in which a quaternary long chain fatty amine is ionically bonded to clay platelets is found to function both as a filler or thickener as well as a compatibilizer in an asphaltic polyurethane (PUR) dispersion. When a PUR prepolymer is mixed into a homogenized blend of asphalt and organoclay under high shear, a phase inversion occurs the result of which is that a microdispersion of asphalt particles (preferably 1 μm–44 μm) becomes the dispersed phase which is uniformly scattered throughout the PUR prepolymer (the continuous phase). This dispersion is found to be an excellent adhesive, particularly for roofing components which can be secured without using conventional fasteners, and it is stable and moisture-curable to afford, when cured, an elastomer having excellent adhesion to surfaces exposed outdoors. It is also user-friendly because it is solvent-free. The asphalt is treated to react all functional groups it may have because they may react with a functional group of the PUR prepolymer. The organoclay compatibilizer may be supplemented with a compatibilizer used in the parent case where the viscosity of the dispersion is to be lowered, and to save on the cost of making the dispersion. A sprayable adhesive dispersion may be formed by diluting the organoclay compatibilized dispersion with a plasticizer which, together with the asphalt and organoclay, becomes an integral part of the elastomer when the PUR is cured.

11 Claims, No Drawings

SOLVENT-FREE, ORGANOCLAY-FILLED ASPHALTIC POLYURETHANE DISPERSION AND METHOD OF MAKING AND USING IT

BACKGROUND OF THE INVENTION

This application is a continuation-in-part application of Ser. No. 07/633,561, filed Dec. 21, 1990 to be issued as U.S. Pat. No. 5,253,461, on Oct. 19, 1993.

The present invention relates to a clay-filled, stable "one-part" adhesive dispersion of asphalt in a polyurethane ("PUR") prepolymer which is curable at ambient conditions to provide a multi-purpose adhesive layer of clay-containing polymer. By "one-part" is meant that the dispersion is ready for use as removed from a container because the dispersion already contains enough catalyst to cure it under ambient conditions in less than 3 hr sufficiently to produce a fluid-tight seal where one component joins another and a layer of the dispersion is interposed therebetween.

As in the parent case, the remarkable and unique property of the dispersion is that the asphalt is the dispersed phase, and the polyurethane prepolymer is the continuous phase. The dispersion of the parent case required a compatibilizer which, upon mixing, interposed itself between molecules of asphalt and those of the PUR prepolymer in such a way as to provide a stable dispersion which had the remarkable and unique property referred to. It is now found that, a relatively small amount of an organoclay, chemically combined with a fatty quaternary amine, may be used to replace the compatibilizer of the parent case.

Despite the dispersion of the parent application having excellent stability, and desirable penetration and adhesion characteristics, it was found that a great deal of energy was required to disperse a clay filler in asphalt well enough to afford a substantially homogeneous ("homogenized") asphalt blend. When the clay-filled asphalt blend was not homogenized, the stability of the dispersion reflected that fact.

The goal is to form a solvent-free, stable dispersion of asphalt in a PUR prepolymer, which dispersion, upon being cured, preferably at ambient conditions, would result in an elastomeric adhesive which can be tailored for multiple different applications. Depending upon the ratio of asphalt to PUR, the amount and types of filler, and the amount of various additives used, the dispersion may be used as a roof coating, or a coating for buried pipelines, an adhesive for multiple layers of roofing membrane in a built-up roof, an adhesive for roofing panels of organic or inorganic material secured to a substrate roof-deck, a sealant for asphalt driveways, a caulk for wall joints where the end surfaces of walls are substantially contiguous, and other related applications. In each case the dispersion is to be used without adding an aliphatic or aromatic liquid commonly used in the past to dissolve asphalt and form a miscible blend with a liquid PUR prepolymer.

The problem was to form a multiphase stable dispersion with varying amounts of clay in it, the amount of filler depending upon what the particular application of the dispersion was to be. At very low filler content, the problem disappeared, but as the concentration of filler in the dispersion was increased, the problem became progressively more apparent.

The dispersion of this invention is limited to the use of asphalt. Asphalt is a dark, cementitious material having a solid or semi-solid consistency, which occurs naturally, or, is produced as a by-product of refining petroleum.

As is well known, clay has a high affinity for asphalt. Once agglomerates of clay particles >about 90 μm (micrometer) are coated with asphalt, they are difficult to break up into small enough particles to form a stable dispersion. By "stable dispersion" I refer to one which can be stored at ambient temperature of 22° C. for at least one month without being adversely affected. Typically a stable dispersion may be stored for several months before it is used.

Agglomerates break up into "stacks" or "books", each smaller than about 45 μm. With sufficient shear energy, each "stack" in turn can be broken up into platelets in the size range from about 0.5–10 μm. When these platelets are scattered throughout asphalt, they form a stable dispersion, so long as the platelets are combined with a quaternized long chain fatty acid, or an equivalent long chain organic molecule which has a relatively hydrophilic terminal portion.

Since it is well known that numerous clays, diatomaceous earth, calcium carbonate, pumice, silicas and carbon blacks of various types are essentially interchangeably used as fillers for an asphalt-containing blend with a PUR prepolymer, there was no reason to consider using an organoclay conventionally used as a thixotrope, as being more advantageous than any of the other known fillers. This was particularly true in the case at hand because the dispersion to be made is relatively unconcerned with providing thixotropic properties. Moreover there was no technical basis upon which one could predicate how chains of a quaternized fatty amine bonded to a "stack" or "book" of clay platelets might interact with asphalt molecules, since a blend of asphalt with the organoclay particles would provide only a single hydrophobic asphalt phase in which solid particles of the organoclay were distributed as a solid particulate second phase, and there is no other phase present to attract the hydrophilic terminal end portion of the quaternary amine.

More specifically, the present invention is directed to the use of an organoclay to form a homogenized blend with asphalt, which blend aptly lends itself to be dispersed as the disperse phase in a liquid PUR prepolymer which forms the continuous phase; and, the dispersion of asphalt in the PUR prepolymer can then be cured under ambient conditions to provide a laminar adhesive medium which can be tailored for use in a particular application.

Because asphalt is inexpensive, has a relatively high penetration value when applied to most porous surfaces, and is relatively weather-resistant and water-impermeable, it has traditionally been used as a main component of protective films, adhesives, binders, etc. Asphalt in blends or emulsions, is used in large quantities for a wide array of products used in paving and roofing; for joint sealants, specialty paints, electrical laminates and hot melt adhesives; as a diluent in the manufacture of low-grade rubber products, as a diluent for the disposal of radioactive waste; for hot-dip coatings, and for water-retention barriers. Many such blends or emulsions are formulated with a curable liquid prepolymer, to be spread at ambient conditions, and to cure after they are spread, into a rubbery mass.

However, the spreadability of such blends generally derives from their being diluted with a volatile solvent which is a common solvent for the asphalt as well as for the prepolymer. Such solvents used have been toluene, aromatic oils, naphtha, mineral spirits or carbon disulfide. Though the amount of a solvent used may only provide partial solubility of the asphalt, the effect of the solvent is to suspend the undissolved asphalt to form a dispersion. After mixing, the dispersion can be easily applied by conventional technology so that, after the solvent evaporates, the asphalt is left intermixed with the other constituents. Despite the use of solvents, the wettability of a prior art asphalt dispersion was less than satisfactory, and this deficiency was more evident with a solventless dispersion. Therefore it was desirable to improve wettability for those applications in which wettability was a dominant concern.

As long as more than 25 years ago, an effort to avoid using a solvent in a blend of a PUR prepolymer and asphalt was disclosed in U.S. Pat. No. 3,179,610 to Wood, but because of the problem of maintaining a stable dispersion he mixed the components and immediately used them to bind an aggregate such as is used in road paving. He then cured and tested the cured aggregate-binder mixture for stability.

The problem of incorporating a bituminous material in a PUR prepolymer was solved in a method disclosed in U.S. Pat. No. 4,871,792 to Lucke who used a combination of a primary plasticizer, namely butylurethane-formaldehydecarbamic acid ester resin, and a secondary plasticizer, namely 1-methyl-2,3-dibenzylbenzene (2,3-dibenzyl toluene), to provide the requisite solubility of the bitumen in the prepolymer. As he states, his goal was to produce a "one-component", that is, single phase, system. This solution to the problem is quite different from the one set forth in this specification which teaches producing a stable dispersion of a bituminous material ("asphalt") which is maintained as a separate phase because it is not soluble in the prepolymer phase.

Thus, though there have been numerous attempts to provide a blend of a liquid, preferably ambient-curable prepolymer, with asphalt, the critical importance of maintaining the asphalt as the dispersed phase in a continuous phase of a polyurethane prepolymer was recognized only in my U.S. Pat. No. 5,008,311 but I was unaware of the importance of the size of dispersed asphalt microglobules or microdroplets (hereafter "particles") to maintain stability. Until relatively recently I was equally unaware that the properties of an organoclay filler, used even in a small amount, as little as 1% by weight (by wt) and no more than 5% by wt, might influence the overall properties of the dispersion far more than the same clay without having the residue of a quaternary fatty amine being grafted onto the clay.

SUMMARY OF THE INVENTION

Maintaining a stable dispersion of asphalt particles in a continuous prepolymer phase is made possible by the use of an organoclay without requiring a compatibilizing agent, or "compatibilizer". A compatibilizer, defined in the '311 patent, has long chains of connected carbon atoms, one end of each chain having, at or near its end, at least one OH group, thought to provide hydrogen bonding with repeating units derived from the ether, ester, isocyanate, siloxane, olefin or diolefin repeating units; the other end of each chain has a high affinity for an asphalt particle. The OH group of the compatibilizer may also react with some of the isocyanate groups on the prepolymer chains, though the extent to which this occurs is not known.

It has been discovered that the organic chains on platelets of the organoclay referred to above may be distributed throughout a mass of asphalt to afford a homogenized mass of clay-filled asphalt, provided enough shear is applied to separate the platelets from a "book" or "stack" of platelets, and to scatter them in the mass of asphalt being mixed. Organoclays are currently commercially available as a powder, the major portion by wt (>50%) of which consists of relatively large agglomerates in the range from about 44 μm to 90 μm, with a small portion about 5–10% even larger than 90 μm.

It has more specifically been discovered that a long chain quaternary amine which could not have been used as a compatibilizer with the PUR prepolymer because of the reactive amine group, if combined with a clay, functions as an excellent compatibilizer. Further, that the clay, which by itself is a filler and thickener, but has no compatibilizing effect, unexpectedly provides such an effect in an organoclay with which it is chemically combined. Still further, when a compatibilizing amount of the organoclay is substituted with the equivalent weight of unmodified conventionally used clay, and the equivalent weight of the quaternary amine portion is substituted with a compatibilizer from the '311 or '461 patents, known to be effective for the purpose at hand, the inversion of the phases is incomplete and the microdispersion formed is unsatisfactory.

Thickening and thixotropic properties of the dispersion formed herein are only incidental properties inculcated in a dispersion to meet the requirements of its particular use. Thickening, per se, can be effected with other fillers which are more efficient thickeners than an organoclay, e.g. calcium carbonate, acetylene black or fumed silica. Further, the slippage of platelets over each other is of marginal benefit, because unlike other uses for organoclays recommended by their manufacturers, no more than 10% by wt, and more preferably less than 5% by wt of the organoclay is used.

It is therefore a general object of this invention to provide an essentially moisture-free, homogenized dispersion of asphalt and a PUR prepolymer with an additive of choice selected from the group consisting of a filler, pigment, phase extender, adhesion promoter, plasticizer and stabilizer to provide desired viscosity, wettability, adhesion, and stabilization against degradation by oxygen and UV light. The asphalt is typically reacted with a blocking agent to remove any functional group likely to react with the PUR prepolymer. In the dispersion, the asphalt has essentially no functional groups reactive with a functional group on said prepolymer.

It is a specific object to provide a process for making a "one-part" dispersion of asphalt in a PUR prepolymer, comprising, (a) mixing asphalt with no more than 5% by wt of an organoclay having reactively combined therewith a quaternized fatty amine under high shear conditions, sufficiently high so as to scatter platelets of said organoclay into said asphalt, and, (b) maintaining such high shear as long as the blend being mixed has a viscosity >500 cp and a grainy appearance, until there is a sudden break in the viscosity of the blend being mixed, as visually indicated by a smooth texture with a characteristic lack of graininess.

The adhesive dispersion is particularly well-adapted for use to seal one component of a roofing system to another, whether membrane to membrane, membrane to the surface of a substrate roof-deck, or a roofing panel to the substrate. Because the dispersion can be formulated with the consistency of a thick syrup, ribbons of syrup may be deposited on a roof-deck, and panels of roofing material may be adhesively secured to the roof-deck without using any fastener which penetrates the surface of the roof-deck. When so secured a panel will resist a wind force of 300 lb/ft$^2$ which is more than double the required resistance.

The key to avoiding the use of the compatibilzer of the parent application is to form a homogenized dispersion of asphalt and an organoclay. The homogenized dispersion can then be dispersed as a stable dispersion of microscopic asphalt particles ("microdispersion") in a liquid, curable prepolymer.

It is therefore a specific object of this invention to provide a stable microdispersion of microscopic asphalt particles in the size range from about 1 μm to about 100 μm, more preferably from about 1 μm to 44 μm, present as a disperse phase in a continuous phase of liquid prepolymer, the stability of the microdispersion being maintained by the presence of the organoclay.

It has specifically been discovered that a microdispersion of asphalt particles, the majority of which are in the size range from about 1–44 μm, when dispersed in a continuous phase of liquid PUR prepolymer may be maintained as a stable dispersion for at least thirty days at a temperature in the range from −20° C. to about 100° C., if the dispersion is stabilized with from 0.5% to 5% of an organoclay.

It is a specific object of this invention to use the foregoing organoclay in an amount greater than 0.5 part per 100 parts by weight in a substantially anhydrous stabilized dispersion of the asphalt in the liquid PUR prepolymer, the blend containing from about 25 to 75 parts by weight of PUR prepolymer and the balance being asphalt; and the prepolymer and the asphalt may each be either plasticized to obtain a desirable viscosity, or extended with a phase-extender. By "substantially anhydrous" is meant a moisture content of less than 0.05%, preferably less than 0.02% as measured by a Karl Fischer Coulometric titrator.

In particular, for asphalt, the plasticizer may be chosen with a view to wet and help disperse the asphalt in the prepolymer phase. Either the PUR prepolymer phase, or the asphalt phase, or both, may be plasticized to improve miscibility of a solid inert organic or inorganic filler, and/or, either the PUR prepolymer or asphalt phase, or both, may include a phase extender which forms a single phase with the respective phase which it extends. A phase extender appears to form an interpenetrating network within the continuous phase in which it is miscible, to promote better adhesion of the adhesive dispersion to a substrate, and to improve wettability of a substrate surface by the dispersion. For example, a terpolymer of ethylene-propylene-diene or EPDM, is an effective phase extenders for the PUR prepolymer. Polybutadiene, polyisobutylene rubber and normally solid nonvolatile hydrocarbon which form a single phase with the asphalt may be used to extend the asphalt. In addition, either phase may be extended with a normally solid inert organic or inorganic filler.

The dispersion may be sprayed onto a surface to provide an adhesive coating from 3 mils to 20 mils thick, preferably from 5–10 mils; the dispersion may be deposited from a translatable dispenser, to form one or more ribbons. Thus, the most desirable form of the dispersion may be chosen for the particular use at hand, whether for bonding overlaps of membrane; or, bonding membrane to flashing; or, bonding roof panels to roof-deck; or, membrane to roof-panels. Preferred panels are made with glass fiber, perlite, and wood fiber board, or foamed polystyrene or foamed polyurethane.

DETAILED DESCRIPTION OF PREFERRED EMBODIMENTS

THE DISPERSION

A. Asphalt

The asphalt used may be straight run, blown, cracked and catalytically or non-catalytically polymerized asphalt, irrespective of their penetrations or softening points. Blown asphalts are normally produced in the presence or absence of catalyts by blowing asphalts or fluxes at elevated temperatures with anoxygen-containing gas such as air. A typical blown asphalt may have a softening point in the range from about 10° C. to about 100° C. Preferred are the straight run asphalts and aromatic asphalts. Aromatic asphalts comprise the bottoms products from the distillation of catalytically cracked gas oil or naphtha. Such asphalts, typically used for roofing and paving, are those having penetrations between 50 and 300, and softening points within the range from about 50° C. to 100° C.

B. Organoclay

The organoclay is prepared as follows, starting with a montmorillonite clay, or any other clay which has a plate-like structure. Such a structure, most preferred, comprises laminar particles arranged in triple layers, one octahedral layer enclosed between two tetrahedral layers. In the tetrahedral layers, silicon is surrounded by 4 oxygen atoms. In the octahedral layer, two aluminum atoms are surrounded by 6 oxygen atoms. The triple layers are connected by chemical bonds to common oxygen atoms.

Part of the silicon in the tetrahedral layers is replaced by aluminum and part of the aluminum in the octahedral layers is replaced by magnesium. This results in a net charge deficit on the surface of the platelets. This charge deficit can be balanced by bonding exchangeable cations such as sodium, to the surface of the platelets. The sodium ions can, in turn, be exchanged with complex organic cations such as quaternary ammonium ions.

The fatty quaternary amines render the platelets organophilic. The manufacturer of an organoclay state that "When added to an organic solvent of suitable polarity and subjected to shear, the fatty quaternary ammonium ions become solvated." However, the compositions of interest herein are substantially solvent-free. Therefore the use of an organoclay was, upon initial evaluation, contraindicated.

If there was a solvent in the system, it was known that the solvation force would keep the clay pellets in suspension, and at this stage, little gelation occurs. The gelation process is complete upon addition of a polar activator. These activators are hydrogen-bonding solvents such as a ($C_1$–$C_4$)-lower alkanol, usually containing small amounts of water. But applicant's composition contains no solvent and no water. If there was a hydrogen-bonding solvent the gelation mechanism would comprise forming hydrogen-bonding bridges between the edges of the platelets. This results in a cage-like structure that can easily break down under shear, but will reform again as the shear is relaxed. This type of behavior is termed thixotropic. Since, to the applicant, such behavior was not of any particular interest with respect to providing a solution to his problem, there was no logical reason to believe that using an organoclay as a substitute for the parent's compatibilizer might be highly effective from all points of suitability. Most preferred is a Tixogel organoclay commercially available from United Catalysts Inc.

C. PUR Prepolymer

The PUR prepolymer is a liquid, curable prepolymer conventionally formed by the reaction of an organic polyisocyanate, preferably a diisocyanate, with a polyol. The —OH group of the polyol reacts with the —NCO group of the diisocyanate, and the resulting addition reaction with hydrogen exchange will link the polyol to the polyisocyanate, creating a urethane linkage.

Because essentially no OH groups are to survive in the prepolymer, an excess of isocyanate groups, in the range from 1 to 50% more than the number of equivalents required, are provided. Preferably, the resulting prepolymer molecules will have from 1 to about 10 unreacted isocyanate functional groups per chain, which isocyanate groups provide reaction sites for curing the prepolymer.

Though triisocyanates and higher polyisocyanates can be used, the preferred polyisocyanates are aromatic diisocyanates such as methylene di-p-phenylene isocyanate ("MDI"), toluene diisocyanate ("TDI"), polymethylene-polyphenylene-diisocyanate, isophorone diisocyanate, and mixtures thereof. Most preferred is MDI.

Suitable polyols include ethylene glycol, propylene glycol, diethylene glycol, polybutadiene polyols, polytetrahydrofuran polyols, polycarbonate polyols, and caprolactone-based polyols. Such polyols can be reacted with an alkylene oxide including ethylene oxide, propylene oxide and butylene oxide for example, to form polyether polyol adducts useful in forming the polyisocyanate prepolymer. The polyol can have a weight average molecular weight ranging from as low as about 250 to about 10,000 or more.

Preferred prepolymers are polyester and polyether diol-diisocyanate prepolymers prepared by reacting an excess of the diisocyanate with polyethers. Such prepolymers are prepared from polyester polyols such as recycled polyethylene terephthalate polyol having an OH No. in the range from about 100 to 300, and polyether diols such as polyoxypropylene glycol diol having a molecular weight in the range from about 1000 to about 3000. Prepolymers may also be prepared with diols of copolymers of (i) acrylic acid and alkylene and polyalkylene diols, or polyoxyalkylene diols; and (ii) acrylonitrile and dienes, such as of a copolymer of butadiene and acrylonitrile in which copolymer the latter is present in a minor proportion by weight. Polyols of acrylate esters are relatively water sensitive and are not favored.

A catalyst is generally preferably present to increase the rate of reaction, especially between the polyisocyanate and the polyol. Catalysts which are useful for this reaction are well known in the art and include, for example, metal catalysts such as tin compounds and bismuth compounds, as well as other metal compounds, such as compounds of cobalt, lead, and, vanadium. Most preferred are the tin compounds, which include the stannous salts, e.g. stannous octoate, stannous acetate, and stannous oleate, the stannic salts, e.g. stannic diacetate, and stannic di-octoate, and also the covalently-linked, so-called organotin compounds, such as the dialkyltin dicarboxylate salts, including, for example, dibutyltin diacetate, and dibutyltin dilaurate, and tributyltin oxide.

Depending upon the viscosity of the polyurethane prepolymer it may be desirable to add a plasticizer to facilitate mixing of the components of the dispersion, and to facilitate dispensing the blend from a container, and spreading the blend. A plasticizer may also decrease the temperature sensitivity of the blend, thus extending durability of the blend when used at temperatures greater than about 60° C. Essentially the same plasticizers used to plasticize asphalt may be used.

The amount of prepolymer used in the blend is necessarily at least as much as will provide a continuous phase in which to disperse the asphalt. It will be evident that the smaller the proportion of asphalt, the easier it will be to provide a continuous phase of prepolymer. Since economics dictate that the amount of prepolymer used be minimized for any specific application, the amount of prepolymer used may be as little as about 25 parts by weight per 100 parts of blend, though as much as 90 parts by weight, but more typically, less than 75 parts are used. Most preferably the amount of prepolymer ranges from 25–50 parts by weight.

D. Additives

A plasticizer is preferably added to the base material to further soften the base material, making it easier to intermix with the prepolymer component. Preferred plasticizers include dibutoxyethyl phthalate ("DBEP"), diisodecyl phthalate ("DIDP"), dibutyl phthalate ("DBP"), butylbenzyl phthalate ("BBP"), dioctyl phthalate ("DOP"), dioctyl sebacate ("DOS"), dioctyl adipate ("DOA"), diethyl butyl sebacate ("DEBS"), dibutoxyethyl glutarate, didecyl glutarate, diisodecyl glutarate, tricresyl phosphate, tributyl phosphate, and still bottom phosphate plasticizers. Phthalic derivative plasticizers are more preferred, and butylbenzyl phthalate is most preferred.

Other additives which may be added include flame retardants, inorganic particulate and fibrous reinforcement, UV stabilizers, blowing agents, perfumants, antistats, insecticides, bacteriostats, fungicides, and the like.

An elastomeric extender may be used provided it forms a single phase with either the asphalt portion or the prepolymer portion. For example, liquid butadiene may be used to extend the asphalt; and, liquid EPDM may be used to extend the prepolymer phase.

A preferred general procedure for forming a blend is as follows: The prepolymer portion is produced in a first batch, and the asphalt portion is produced in a separate batch. The two portions are then blended together. The order of blending is not critical, but typically the prepolymer portion is added to the asphalt portion.

All reference to "parts" herein are to "parts by weight per 100 parts of asphalt blend".

The asphalt portion is prepared as follows:

1. Plasticizer(s), if necessary, having a relatively low viscosity in the range from 150–500 cp is charged to a reactor under a nitrogen blanket, first, to provide a fluid medium into which the asphalt can be mixed. The amount of plasticizer is preferably about 2 to about 40 parts, most preferably from 20 to 40 parts. To ensure that the asphalt blended with organoclay is anhydrous, a dessicant in an amount from about 0.1 to 2 parts is added. Such a dessicant is p-toluolsulfonylisocyanate (PTSI) or calcium oxide which picks up residual water which might be present in the organoclay.

2. The organoclay is then added. The preferred amount of organoclay is at least 0.5 part, preferably from 2 to 5 parts. Mixing is continue until the grainy texture of the mixture disappears indicating that "stacks" of platelets have been broken up and dispersed.

3. The asphalt is heated in a substantially anhydrous environment until fluid and the hot asphalt is added to the mixture of plastiicizer and organoclay under high shear mixing conditions. The moisture-free environment is maintained throughout the blending procedure. The amount of asphalt is preferably about 10 to about 80 parts, most preferably from 15 to 60 parts.

4. Mixing with a high speed disperser (3200–7200 revs/min) thoroughly disperses the organoclay in the plasticizer.

5. Adhesion promoter or wettability improver, if desired, is added. For example, polyisobutylene rubber is used in the range from 1 to 40 parts, preferably from 1 to 5 parts.

4. The blocking agent, preferably an anhydride such as maleic anhydride, isocyanate or carbodiimide, is added. The preferred amount of blocking agent is about 0.2 to about 5 parts, most preferably about 0.5 to 1.5 parts.

5. Catalyst is added (preferably tin, imidizole, or other metal catalyst) preferably in the range from about 0.01 part to 0.5 part.

6. Mixing with a high speed disperser (3200–7200 revs/min) is continued and desired thickeners, thixotropes, antioxidants and any other additives are added. The preferred amount of such additives is from 2 to about 25 parts.

After thoroughly mixing, the moisture content is checked with a Karl Fischer Coulometer. If the moisture content is higher than 0.02%, a moisture scavenger is added until the moisture content is less than 0.02%.

The PUR prepolymer is prepared at elevated temperature (about 60°–90° C.) under anhydrous conditions as follows:

1. About 20 to about 75 parts, preferably from 40 to 60 parts of a diol or triol having an equivalent weight from 1000 to 10,000; about 2 to 25 parts, preferably 10 to 15 parts plasticizer; about 6 to 40 parts and preferably from 5 to 12 parts of about 150 equivalent weight diisocyanate; and from about 0.02 to 1 part of catalyst (preferably tin) are charged to a mixing zone and mixed into a homogeneous mixture.

2. The PUR prepolymer preferably comprises about 30 to 80 parts, more preferably, from 40 to 60 parts of the final material.

The PUR prepolymer is typically added to the asphalt portion and high shear mixing, sufficient to provide the microdispersion is continued until the asphalt having the desired particle size, is microdispersed in the continuous phase. The particle size is checked by periodcially examining samples under a microscope fitted with a ultraviolet light. The mixture is pumped into packaging containers, allowed to cool and stored.

In the following examples, all 'parts' referred to, are 'parts by weight' based on 100 parts of blend, unless otherwise specified.

The following detailed description is of the most preferred embodiment of the dispersion used in its most favored application, namely as an ahdesive for roofs on large office buildings, warehouses and the like, which have "flat roofs". A flat roof typically comprises a waterproof membrane secured to a thermal insulation beneath, which in turn is secured to the substrate of the roof-deck. Because the roof is built up"on the substrate, such a roof is referred to as a "built-up roof" or "BUR".

Roofing panels are usually for insulating the roof-deck though they may also be used to provide a relatively rigid laminar surface for pedestrian traffic. The panels are prefabricated boards of porous polymer or pressed wood chips; or made from insulating concrete poured into molds, and usually topped with more efficient rigid board insulation.

The panels have adequate shear strength to distribute tensile stresses in the membrane to prevent it splitting, and are dimensionally stable under varying atmospheric conditions. It is essential that the panels be secured to the roof-deck well enough to resist delamination due to uplifting forces generated by high winds.

The waterproof membrane typically comprises a web of felt and/or glass fibers impregnated with asphalt or coal tar pitch. The web reinforces the asphalt and distributes tensile stresses generated when the asphalt cools. Without the web, such stresses would crack the asphalt because it becomes brittle at temperatures approaching 0° C. Alternatively, the membrane may be a flexible web of a synthetic resinous material. Multiple webs are used to cover the roof-deck in 2-ply, 3-ply or 4-ply configurations successive webs being "lapped" over an area of the preceding web, in an amount sufficient to provide the number of plies desired.

The membrane is typically used in combination with metallic and/or nonmetallic flashing which guards against leakage through portions of the membrane which are pierced or terminated, such as at gravel stops, walls, curbs, expansion joints, vents and drains.

Mineral aggregate (normally gravel, crushed rock, or slag) is often spread atop the membrane to hold it down on the roof deck and protect the membrane from wind, rain, solar radiation, and fire. Such aggregate may be unnecessary on smooth-surfaced asphalt roofs having glass-fiber felts.

The roof-deck, which may be of metal, wood, concrete, gypsum, or equivalent materials is sheeted with multiple plies (generally from 2 to 4) of membrane, which cover contiguous roofing panels, typically of insulation such as foamed polystyrene. The roof-deck may be substantially horizontal, or steeply inclined. The viscosity of the dispersion to be deposited as ribbons is adjusted for the slope of the roof, the steeper the slope, the more viscous the dispersion. Once applied to the substrate surface, the time of cure is determined by the amount of accelerator in the dispersion. The ribbons remain soft and compressible so that a panel placed on the ribbons is tightly secured with its lower surface contiguous to and coextensive with the corresponding surface of the substrate.

If a vapor barrier is placed between the roof-deck and roofing panels, the dispersion is deposited on each side of the vapor barrier to ensure it is secured to the roof-deck.

For economic reasons, or, because the amount of organoclay (used as the only compatibilizer) adversely influences the curing time for the dispersion, or, because the amount of clay in the organoclay may be more than is desirable for the particular application at hand, when only the organoclay is used as the compatibilizer, the adhesive dispersion may be formulated with a mixture of organoclay and the compatibilizer of my '311 or '461 patents. The most preferred curing systems are those which cure in about an hour. However, ordinary skill and experimentation might be required to adjust the rate of cure for any particular adhesive system used in an alternative embodiment of the present invention.

When a compatibilizer of the '311 or '461 patents is used to supplement the function of the organoclay, the compatibilizzer is used in a minor amount relative to the organoclay. Typically, as a supplementary compatibilizer it is used in an amount in the range from 0.01 to 2 parts per 100 parts of the adhesive dispersion. Such a compatibilizer is preferably chosen from (A) an ester of (i) a polyol having the formula $$R^1(OH)_{n'}$$

wherein $R^1$ represents $C_2$–$C_{12}$ branched or straight chain hydrocarbyl, and n' is an integer in the range from 2 to 4; and, (ii) a $C_9$–$C_{24}$ fatty acid, so that at least one OH group remains on the ester formed;

(B) an ester of (i) a polycarboxylic acid having the formula $$R^2(COOH)_{n''}$$

wherein $R^2$ represents $C_4$–$C_6$; and, n'' represents 2 or 3; and, (ii) a $C_9$–$C_{24}$ acyclic alkanol; so that at least one OH group remains on said ester;

(C) a mono- or diester of a polyether polyol having a repeating unit of from $C_3$–$C_8$ carbon atoms, and, a $C_9$–$C_{24}$ fatty acid;

(D) an ester of a polyester polyol and a $C_9$–$C_{24}$ alkanol, said ester having at least one OH group remaining in a terminal portion thereof;

(E) an ester of a polyether diol and a $C_2$–$C_{24}$ fatty acid, said polyol being selected from the group consisting of a polyalka($C_5$–$C_6$)diene diol and, a polydimethylsiloxane diol; and, (F) an ester of a polyester polyol having a repeating unit derived from acrylic acid and a polyol selected from the group consisting of a $C_2$–$C_{12}$ alkylene diol, or triol; a polyalkylene $C_2$–$C_4$ diol; and a polyoxyalkylene $C_2$–$C_4$ diol.

The dispersion may be stored at a temperature in the range from about −20° F. (−22° C.) to about 160° F. (71° C.), but is preferably used at a temperature in the range from 0° C. to 30° C. The optimal coverage rate of the roofing adhesive is preferably about 0.5 to about 2 gals/100 $ft^2$ (gallons per hundred square feet), more preferably, 0.7 to about 1.5 gals/100 $ft^2$. When used as a ribbon, the ribbon has a nominal diameter of from 0.75 cm to 2 cm, and typically 3 ribbons are placed about 30 cm apart to secure a 4 ft×8 ft panel.

In the following examples, all 'parts' referred to, are 'parts by weight' based on 100 parts of the asphalt blend, when the asphalt portion is prepared; and to 100 parts of the PUR prepolymer when the prepolymer portion is being prepared, unless otherwise specified.

EXAMPLE 1

Preparation of a typical Asphaltic PUR adhesive dispersion

In this example is illustrated an adhesive dispersion without a known compatibilizer, where the only compatibilizing function is provided by the organoclay used in a concentration of 3.41% of the asphalt blend. Such a dispersion is prepared in two parts, an asphalt blend homogenized with organoclay, and a PUR prepolymer portion.

The asphalt blend is prepared as follows:

1. To a mixing vessel add 28.68 parts butylbenzyl phthalate and 5.75 parts dioctyl adipate and heat to 80° C. (175° F.) while mixing at high speed, and add 0.86 part maleic anhydride, to make a single phase mixture of the plasticizers. A mixture of plasticizers is added for economic reasons. Mixing is continued for about 30 min.
2. Add 3.41 parts of Tixogel organoclay and continue mixing at high shear until the mixture has a smooth consistency.
3. Add 57.39 parts 200 Pen Asphalt and keep mixing at high shear until the grainy mixture becomes smooth.
4. Add 2.27 parts of polyisobutylene rubber broken up into small pieces to facilitate dispersion into the mixture. The, 0.20 part of an antioxidant (Cyanox 2777), dibutyltin diacetate catalyst, about 0.068 part, and 1.14 parts PTSI. The Brookfield viscosity (#4 spindle, 10 rpm, 25° C.) is about 100,000 cp.

A polyurethane prepolymer is prepared as follows:

In a closed, substantially moisture-free, heated vessel, are mixed 750 parts polyoxypropylene glycol triol (2000 equivalent weight) and 150 parts butylbenzyl phthalate at 32° C. at low speed (200 rpm) and the heating is discontinued when the temperature reaches 49° C. A sample tested for moisture shows a moisture content of 325 ppm. For moisture control, 5 cc of PTSI are stirred into the mixture and then 160 parts MDI are added and thoroughly stirred into the mixture. Lastly, about 0.4 part tin laurate catalyst, is added. The maximum temperature reached is about 55° C. The Brookfield viscosity (#4 spindle, 10 rpm, 25° C., 77° F.) is about 24,000 cp.

While 250 parts of the asphalt blend are mixed at high shear in a homogenizer (speed 20,000 rpm, sweep blade speed 80 rpm), an equal amount by weight of the PUR prepolymer is added and mixed for about 15 minutes, limiting the temperature to 82° C., until the morphology of the entire mixture is the desired microdispersion. The blend is allowed to cool and stored in an anhydrous environment.

The adhesive dispersions obtained with the procedure as described above have viscosities (Brookfield HBT spindle #4, 10 rpm at 20° C.) in the range from 100,000–300,000 cps depending upon the amount of organoclay used. Though 3.41% organoclay provides an excellent dispersion, the viscosity may be higher than is desired for many applications. For trowelling by hand, as much as 10% organoclay may be used, but the dispersion gets progressively more viscous as the content of organoclay is increased. There is no economic reason for using an organoclay as a filler, or thickener since acetylene black and equivalent fillers provide such a function more effectively than an organoclay. To lower the viscosity of a dispersion, the amount of organoclay may be reduced, and the equivalent compatibilizing function of the absent organoclay provided by a compatibilizer such as PGMS.

The above blend is fairly well cured after 2 hr, and is found to fully cure overnight to a commercially acceptable elastomer under most commonly encountered outdoor weather conditions. The overnight relative humidity can be as low as about 30% and the overnight temperature can be as low as about 0° F. and the material will properly cure in about 10 to about 20 hours. At higher temperatures and relative humidities, the material will cure more quickly.

The amount of cure time can be adjusted by increasing or decreasing the amount of tin catalyst in the formulation, or, by adding an oxazolidine or ketimine in an amount of about 1 to about 5 parts. The adhesion and wettability may also be adjusted by addition of from 0.01–0.3 part of a silane.

Upon curing, the resulting product of example 1 had excellent peel adhesion, tensile adhesion and lap shear. The material was durable, water- and weather-resistant, and is useful as an adhesive in roofing applications.

EXAMPLE 2

In this example is illustrated an adhesive dispersion in which the organoclay is replaced with a chemically unmodified ("plain") clay typically used as a thickener, and a compatibilizer (PGMS from my '461 patent), the amount of plain clay corresponding in weight to that of the organoclay without the quaternary fatty amine; and, the amount of compatibilizer corresponds in weight to that of the quaternary amine portion (17% by wt) of the organoclay. 3.41% organoclay corresponds to 23.93 parts of organoclay which consists of 20.46 parts clay and 3.47 parts quaternary amine. Accordingly, the asphalt blend is prepared as before except that 20.46 parts of Min-u-gel AR clay, which is commonly used as a filler in a manner analogous to the filler function of the organoclay, and 3.47 parts PGMS are added separately.

The asphalt blend appeared to have a smooth texture indicating it is homogenized.

250 parts of the asphalt blend made above are mixed at high shear, as in example 1 above, with an equal amount by weight of the PUR prepolymer until an inversion of the phases is seen to have occurred. Inspection of sample shows that the inversion is incomplete and that a majority of the asphalt particles in the dispersion are much larger than 100 μm. Despite mixing for an additional 15 min there is no visually observable improvement in the unsatisfactory dispersion.

This conclusively indicates that the clay portion of the organoclay exerts, between asphalt and a PUR prepolymer, a surprisingly large compatibilizing effect. Clearly, the separately added conventional compatibilizer, in the amount used, is ineffective.

It must be kept in mind that, a quaternary amine, by itself cannot be used as a compatibilizer because the amine group would react with the —NCO groups of the PUR prepolymer and partially gel the dispersion prematurely.

EXAMPLE 3

Preparation of a typical Asphaltic PUR adhesive dispersion

In this illustrative example the amount of organoclay used is decreased to 2.86% of the asphalt blend, and, because such lower amount of organoclay, by itself, does not produce a sufficiently good microdispersion of optimally small 1 μm–44 μm asphalt particles, the function of the compatibilizing function of the organoclay is supplemented with PGMS compatibilizer.

As in example 1, the dispersion is prepared in two parts, the asphalt blend being made first with 3.41 parts of the organoclay, polyisobutylene rubber and 0.9 parts PGMS, the other components being the same. The asphalt blend is homogenized. 250 parts of this asphalt blend are then dispersed in 250 parts of the PUR prepolymer portion. Samples examined after mixing in the homogenizer indicate a highly satisfactory dispersion is obtained. The dispersion is allowed to cool and is stored in an anhydrous environment.

The adhesive dispersions obtained using a conventional compatibilizer to supplement the organoclay, with the procedure as described above, have viscosities (Brookfield HBT spindle #4, 10 rpm at 20° C.) in the range 40,000–90,000 cps.

As before, the above dispersion is fairly well cured after 2 hr at 22° C. and 80% relative humidity.

EXAMPLE 4

In the following illustrative example is shown the effect of substituting "plain" clay (without the grafted fatty quaternary amine), for the organoclay in example 3 above, the amounts being the same by weight, to determine the effect of using only the supplemental known compatibilizer without the organoclay. The particular compatibilizer chosen in each of the illustrative examples is PGMS, to maintain the viability of the comparisons made, but any other could be used. Others readily available are, bis stearyl ester polypropylene diol, ethylene glycol monostearate, triethylene glycol caprate caprylate, and triethylene glycol dipelargonate.

The same procedure used in example 1 above is followed, except that Min-u-gel AR clay is substituted for the organoclay, and longer times and higher mixing temperatures are used, but not so high as to adversely affect the effectiveness of the additives, to facilitate formation of a microdispersion. Accordingly, mixing prior to adding the Min-u-gel AR clay was at 93° C. As before, 0.9 part of PGMS (0.22% by wt of the asphalt blend), is added along with the other components, all of which are added in the same amounts as in example 1. Mixing after addition of the clay was at 121° C. max. Despite addition of the 0.9 part of PGMS (0.22% by wt of the asphalt blend), the asphalt blend had a grainy appearance indicating that the hot blend was not homogenized, and upon cooling, solidified. This conclusively indicates that the organoclay provides a homogenizing function as well as functioning as a filler. Since the asphalt blend is neither homogeneous nor flowable at ambient temperature, both of which properties are deemed essential for a practical PUR-asphalt blend, it is not added to the PUR prepolymer.

EXAMPLE 5

In the following illustrative example is shown the effect on homogeneity of the asphalt blend if clay, whether organoclay or "plain" clay, was left out in example 1 above. No compatibilizer is added in this demonstration since the blend of asphalt with plasticizers and other additives is not going to be blended with a PUR prepolymer.

The same procedure used in example 1 above is followed, except that no clay is added. The time for mixing (30 min) is long enough and the mixing temperature is high enough ( same as those used in example 1) and the hot asphalt blend is quickly homogenized. Whether particles of asphalt are dispersed in the plasticizer, or vice versa is not visually distinguishable indicating that one or the other component may be present in colloidal form with particles so small that the hot mixture behaves as if it was a solution. However, upon cooling the mixture solidifies. This conclusively confirms that the asphalt and plasticizers form what appears to be equivalent to a single phase, and that, if this single phase is to be microdispersed in a PUR prepolymer, either the organoclay or the compatibilizer, or both, must be present to provide the requisite compatibilizing function.

EXAMPLE 6

In the following example, a sprayable dispersion is produced. By "sprayable" is meant that, the viscosity of the solvent-free, clay-filled dispersion is low enough so that it can be sprayed through a conventional airless spray gun. Advantage is taken of the fact that the plasticizer not only forms what appears to be a colloidal solution with asphalt, as illustrated in example 5, but the plasticizer has a comparable effect even with the asphaltic PUR prepolymer blend. Thus, a low viscosity dispersion may be made by using a relatively large amount greater than 40 parts per 100 parts of adhesive dispersion, of a fluid plasticizer. Preferably more than 50 parts of the plasticizer is used, that is, a major proportion by weight, relative to either the asphalt content or the PUR prepolymer content of the blend.

A homogenizer is charged with 300 parts of the asphalt blend prepared in example 3 above, and an equal amount by wt of PUR prepolymer (also prepared in example 3) is gradually mixed into the asphalt, commencing at 49° C., with the homogenizer @20,000 rpm, and sweep blade speed 80 rpm; after 10 min the temperature is at 71° C. and inversion is obtained, that is, the asphalt phase becomes the discontinuous phase and the PUR prepolymer the continuous phase; after 20 min the temp is at 85° C. and a microdispersion is obtained;

after 30 min mixing at 87° C., to the microdispersion is added 250 parts of benzylbutyl phthalate, 5 parts of acetylene carbon black and 1 part Z-6040 silane. Mixing is continued at 85° C. and stopped after a total of 40 min.

The blend obtained is very fluid and homogeneous. The Brookfield viscosity (Brookfield HBT spindle #4, 10 rpm at 20° C.) is 8800 cp. Using a Burrell Sievers flow meter test to measure flowability, it is found that 20 g of blend flows through a 10 psi orifice (0.104" diam) at 25° C. in 30.5 sec. Other sprayable blends are made in an analogous manner, varying the amounts of the components used to provide flow rates in the range from 5–45 secs, preferably from 5–15 sec.

The sprayable adhesive is sprayed onto lapping portions of a butyl rubber membrane in an amount of about 1.5 gal–2 gal per 100 $ft^2$ to form a layer about 30 mils thick, which skins over in 93 min indicating curing is under way, and upon curing being completed, provides a water-tight seal.

The adhesive may also be sprayed onto a rigid panel to afford a coating thick enough to secure the panel to the surface of a roof-deck. The panel may be any conventional prefabricated board, particularly a foamed panel of insulation, or poured insulating concrete fills having adequate shear strength to distribute tensile stresses in a membrane to prevent it splitting, and sufficient compressive strength to withstand traffic. The dispersion, upon curing provides enough adhesive and cohesive strength to resist delamination due to wind uplift forces.

Having thus provided a general discussion, described the adhesive dispersion formed with an organoclay, and the overall process for making it, in detail and illustrated the invention with specific examples of the best mode of carrying it out, it will be evident that the invention has provided an effective solution to a difficult problem. It is therefore to be understood that no undue restrictions are to be imposed by reason of the specific embodiments illustrated and discussed, and particularly that the invention is not restricted to a slavish adherence to the details set forth herein.

I claim:

1. A substantially solvent-free adhesive dispersion of asphalt microdispersed in a liquid polyurethane prepolymer, comprising, a substantially anhydrous, stable, moisture-curable blend of asphalt microdispersed as a dispersed phase within a continuous phase of a liquid polyurethane prepolymer, said dispersed phase consisting of asphalt particles in the size range from 1 μm to 100 μm having essentially no functional groups reactive with a functional group of said liquid prepolymer, said particles comprising asphalt and an organoclay having platelets which have a quaternary ammonium ion ionically bonded to their surfaces, said organoclay being present in an amount in the range from 0.05 to 10 parts per 100 parts of said asphalt blend, whereby said adhesive dispersion is stable without being cured when stored under essentially anhydrous conditions at a temperature in the range from about −20° C. to 75° C., and after storage is flowable at ambient conditions.

2. The adhesive dispersion of claim 1 wherein, said asphalt blend and said polyurethane prepolymer are each free of an added polar activator for said organoclay; said organoclay has a plate-like structure comprising laminar particles arranged in triple layers, one octahedral layer enclosed between two tetrahedral layers within which silicon is surrounded by 4 oxygen atoms;

said octahedral layer has two aluminum atoms surrounded by 6 oxygen atoms; and, said triple layers are connected by chemical bonds to common oxygen atoms.

3. The adhesive dispersion of claim 2 including, an additive selected from the group consisting of a filler, pigment, phase extender, adhesion promoter, plasticizer and stabilizer to provide desired viscosity, wettability, adhesion, and stabilization against degradation by oxygen and ultraviolet light;

a known compatibilizer in a minor amount by weight relative to the amount of said organoclay;

said asphalt blend and said polyurethane prepolymer are present in a ratio in the range from 25:75 parts to 75:25 parts per 100 parts of said dispersion;

said asphalt particles are in the size range from 1 μm–44 μm; and, said organoclay is a montmorillonite clay.

4. The adhesive dispersion of claim 2 wherein, said prepolymer comprises the reaction product of a polyisocyanate and a polyol said polyol is a polyether polyol or polyester polyol, said polyether polyol is selected from the group consisting of polycaprolactone polyol, polytetramethylene glycol, and a polyoxyalkylene diol or triol; and, said polyester polyol is a recycled polyethylene terephthalate polyol having an OH No. in the range from about 100 to 300, and an equivalent weight in the range from about 1000 to about 3000.

5. The adhesive dispersion of claim 4 wherein, said prepolymer comprises the reaction product of a polyisocyanate and a polyol, said polyether polyol is selected from the group consisting of polyoxypropylene glycol triol, polyoxypropylene diol and polyoxybutylene glycol.

6. The adhesive dispersion of claim 2 wherein said asphalt is obtained from (a) residues produced by atmospheric and vacuum distillation of crude petroleum; (b)

oxidation or air blowing of asphalts obtained from the residues produced in (a); (c) deasphalting of petroleum residues of lubricating oils of asphalt origin; and, (d) blending hard propane asphalts from (b) with resins and oils to produce the reconstituted asphalts.

7. The adhesive dispersion of claim 6 wherein said asphalt is reacted with a blocking agent present in an amount in the range from 0.1 to 5 parts by weight per 100 parts of said blend; and said known compatibilizer is selected from the group consisting of (A) an ester of (i) a polyol having the formula $$R^1(OH)_{n'}$$

wherein $R^1$ represents $C_2$–$C_{12}$ branched or straight chain hydrocarbyl, and n' is an integer in the range from 2 to 4; and, (ii) a $C_9$–$C_{24}$ fatty acid, so that at least one OH group remains on the ester formed;

(B) an ester of (i) a polycarboxylic acid having the formula $$R^2(COOH)_{n''}$$

wherein $R^2$ represents $C_4$–$C_6$; and, n'' represents 2 or 3; and, (ii) a $C_9$–$C_{24}$ acyclic alkanol; so that at least one OH group remains on said ester;

(C) a mono- or diester of a polyether polyol having a repeating unit of from $C_3$–$C_8$ carbon atoms, and, a $C_9$–$C_{24}$ fatty acid;

(D) an ester of a polyester polyol and a $C_9$–$C_{24}$ alkanol, said ester having at least one OH group remaining in a terminal portion thereof;

(E) an ester of a polyether diol and a $C_2$–$C_{24}$ fatty acid, said polyol being selected from the group consisting of a polyalka($C_5$–$C_6$)diene diol and, a polydimethylsiloxane diol; and, (F) an ester of a polyester polyol having a repeating unit derived from acrylic acid and a polyol selected from the group consisting of a $C_2$–$C_{12}$ alkylene diol, or triol; a polyalkylene $C_2$–$C_4$ diol; and a polyoxyalkylene $C_2$–$C_4$ diol.

8. The adhesive dispersion of claim 7 including an elastomeric phase extender forming a single phase with said asphalt.

9. The adhesive dispersion of claim 8 wherein said elastomeric phase extender is selected from the group consisting of polybutadiene and polyisobutylene, and said known compatibilizer is selected from the group consisting of propylene glycol monostearate, bis stearyl ester polypropylene diol, ethylene glycol monostearate, triethylene glycol caprate caprylate, and triethylene glycol dipelargonate.

10. The adhesive dispersion of claim 7 wherein said blend includes an elastomeric phase extender forming a single phase with said liquid polyurethane prepolymer.

11. The adhesive dispersion of claim 9 wherein said elastomeric phase extender is a terpolymer of ethylene-propylene-diene, and said known compatibilizer is selected from the group consisting of propylene glycol monostearate, bis stearyl ester polypropylene diol, ethylene glycol monostearate, triethylene glycol caprate caprylate, and triethylene glycol dipelargonate.

* * * * *